US011291291B2

(12) United States Patent
Adney Callihan

(10) Patent No.: US 11,291,291 B2
(45) Date of Patent: Apr. 5, 2022

(54) TACTICAL GEAR HOLDER

(71) Applicant: ETHOS SURVIVAL, INC., Fort McCoy, FL (US)

(72) Inventor: Wendy Kay Adney Callihan, Fort McCoy, FL (US)

(73) Assignee: Ethos Survival Inc., Fort McCoy, FL (US)

( * ) Notice: Subject to any disclaimer, the term of this patent is extended or adjusted under 35 U.S.C. 154(b) by 0 days.

(21) Appl. No.: 17/218,131

(22) Filed: Mar. 30, 2021

(65) Prior Publication Data

US 2021/0298461 A1 Sep. 30, 2021

Related U.S. Application Data

(60) Provisional application No. 63/002,288, filed on Mar. 30, 2020.

(51) Int. Cl.
*A45F 5/02* (2006.01)

(52) U.S. Cl.
CPC ..... *A45F 5/02* (2013.01); *A45F 2005/025* (2013.01); *A45F 2200/0591* (2013.01)

(58) Field of Classification Search
CPC ..... A45F 5/02; A45F 2005/025; A45F 2200/0591; A45F 5/021; A45F 2200/0575; F41C 33/0263; F41C 33/0209; B62B 29/025; Y10S 224/931; Y10S 224/904
USPC ..... 224/245, 197
See application file for complete search history.

(56) References Cited

U.S. PATENT DOCUMENTS

| | | | | |
|---|---|---|---|---|
| 1,566,195 | A * | 12/1925 | Gandrau | A45F 5/022 24/1 OA |
| 1,756,677 | A * | 4/1930 | Cook | F42B 39/02 224/245 |
| 4,754,528 | A * | 7/1988 | Lyons | G01B 3/1071 24/3.12 |
| 6,752,299 | B2 * | 6/2004 | Shetler | A45F 5/02 224/197 |
| 9,476,670 | B2 * | 10/2016 | Parsons | F41C 33/041 |
| 10,317,169 | B2 * | 6/2019 | McKendrick | F41C 33/0236 |
| 10,712,124 | B2 * | 7/2020 | Courtney | A45F 5/02 |
| 10,743,642 | B2 * | 8/2020 | Tran | F16B 2/005 |
| 2005/0115999 | A1 * | 6/2005 | Johnson | A45F 5/021 224/269 |

* cited by examiner

*Primary Examiner* — Adam J Waggenspack
(74) *Attorney, Agent, or Firm* — Mark C. Johnson; Johnson Dalal

(57) ABSTRACT

A tactical gear holder for securely retaining tactical gear comprising a body having a lower end, an upper end opposing the lower end and defining an upper aperture sized to receive an article of tactical gear, a rear sidewall defining an adjustment aperture and having an outer rear side surface and an inner rear side surface, a front sidewall, a left sidewall, and a right sidewall, and a body cavity sized to receive articles of tactical gear. The tactical gear holder further comprises an internal gear retention member, a first portion, and a distal free end operably configured to selectively translate, independent of the first portion of the internal gear retention member, within the body cavity through rotation of a set screw disposed within the adjustment aperture, thereby biasing the article of tactical gear within the body cavity and against the outer retainer surface and the inner front side surface.

15 Claims, 8 Drawing Sheets

TACTICAL GEAR HOLDER

FIELD OF THE INVENTION

The present invention relates generally to holsters for retaining tactical gear and, more particularly, relates to a holster operably configured to selectively adjust the retention of tactical gear within the holster.

BACKGROUND OF THE INVENTION

Tactical gear has grown in popularity over the years so much so that tactical gear is no longer exclusively used by members of the military and law enforcement personnel but by a wide majority of the civilian population, as well. Although the use of tactical gear has greatly expanded, the accessories and tools used to organize, store, and compartmentalize tactical gear on a user's clothing is still characterized by significant shortcomings. One principal limitation is the large amount of surface area or "real estate" that existing prior art covers on a user's person. Existing tactical gear holders are overly bulky, heavy, and take up valuable space on law enforcement personnel's duty belts which can be used for additional gear or which can be entirely freed up to allow the user to move around more freely. Additional limitations include having a retention and storage mechanism which does not securely hold the tactical gear in place, thereby resulting in the tactical gear repeatedly coming loose and falling out from the holder during movement, e.g., during pursuit or when running, jumping, or walking, or which requires a series of steps or a prolonged period of time to release the tactical gear stored therein. Further limitations include lack of durability and lack of adjustability, i.e., an inability to store more than one tactical item in the holder at any given time.

Therefore, a need exists to overcome the problems with the prior art as discussed above.

SUMMARY OF THE INVENTION

The invention provides a tactical gear holder that overcomes the hereinafore-mentioned disadvantages of the heretofore-known devices and methods of this general type and that provides a compact, durable, adjustable, and easily deployable holder for tactical gear that can be utilized by professionals and civilians alike. The small and compact dimensions of the tactical gear holder free up valuable surface area and "real estate" on a user's person to allow for additional gear to be attached thereto or to simply provide the user with greater freedom and ease of movement. The structure of the tactical gear holder also beneficially provides a more secure fit of the tactical gear within the tactical gear holder to prevent the tactical gear from inadvertently coming loose or falling out during movement. Further, tactical gear stored within the tactical gear holder can be easily and quickly released for efficient and convenient deployment when the need arises. The present invention also allows a user to selectively vary and adjust the internal volume of the tactical gear holder to accommodate storage of more than one item therein for greater versatility.

With the foregoing and other objects in view, there is provided, in accordance with the invention, a tactical gear holder comprising a holster body having a lower end, an upper end opposing the lower end and defining an upper aperture sized to receive an article of tactical gear, and a rear sidewall defining an adjustment aperture and with an outer rear side surface and an inner rear side surface opposing the outer rear side surface, a front sidewall opposing the rear sidewall and with an outer front side surface and an inner front side surface opposing the outer front side surface, a left sidewall with an outer left side surface and an inner left side surface opposing the outer left side surface, and a right sidewall opposing the left sidewall and with an outer right side surface and an inner right side surface opposing the outer right side surface, the inner rear side surface, the inner front side surface, the inner left side surface, and the inner right side surface defining and enclosing a body cavity sized to receive the article of tactical gear. The tactical gear holder further comprises an internal gear retention member with an inner retainer surface, an outer retainer surface opposing the inner retainer surface, a first portion coupled to the inner rear side surface of the rear sidewall, and a distal free end operably configured to selectively translate, independent of the first portion of the internal gear retention member, within the body cavity through rotation of a set screw disposed within the adjustment aperture, thereby biasing the article of tactical gear within the body cavity and against the outer retainer surface and the inner front side surface.

In accordance with one embodiment of the present invention, the holster body and the internal gear retention member are of a substantially rigid material.

In accordance with a further feature of the present invention, at least one fastening member is coupled to the outer rear side surface of the rear sidewall and operably configured to securely fasten the holster body to an article of clothing.

In accordance with one embodiment, the at least one fastening member includes two clasp members with one of the two clasp members operably configured to rotate and mechanically couple to another of the two clasp members to securely fasten the holster body to the article of clothing.

In accordance with a further feature of the present invention, the body is operably configured to rotate 360° with respect to an attachment point defined by a fastener coupling the at least one fastening member to the body.

In accordance with another feature, the rear sidewall includes an upper rear edge defining the upper end of the holster body and defines a rear sidewall length separating the upper rear edge of the rear sidewall and the lower end of the holster body and wherein the front sidewall includes an upper front edge defining the upper end of the holster body and defining a front sidewall length separating the upper front edge of the front sidewall and the lower end of the holster body, the rear sidewall length greater than the front sidewall length by at least 10% of the front sidewall length.

In accordance with one embodiment of the present invention, the internal gear retention member comprises a proximal end opposite the distal free end, wherein the first portion includes the proximal end of the internal gear retention member and with the inner retainer surface flush against the inner rear side surface of the rear sidewall at the first portion and retained thereto with a fastener.

In accordance with yet another feature, rotation of the set screw is operably configured to generate an acute angle with respect to the distal free end and the inner rear side surface of the rear sidewall.

In accordance with another feature of one embodiment of the present invention, the outer retainer surface is substantially planar and the forms curvilinear shape spanning from a proximal end of the internal gear retention member opposite the distal free end.

In accordance with yet another feature, rotation of the set screw is operably configured to place the distal free end in a rotationally retained position relative to the inner rear side surface of the rear sidewall.

In accordance with an alternate embodiment of the present invention, the tactical gear holder comprises a holster body having a lower end, an upper end opposing the lower end and defining an upper aperture sized to receive an article of tactical gear and a sidewall with an inner side surface enclosing and defining a body cavity sized to receive the article of tactical gear, the sidewall defining an adjustment aperture; and an internal gear retention member with an inner retainer surface, an outer retainer surface opposing the inner retainer surface, a first portion coupled to the inner side surface with a fastener, and a distal free end operably configured to selectively translate, independent of the first portion of the internal gear retention member, within the body cavity through rotation of a set screw disposed within the adjustment aperture, the internal gear retention member having a first position along a retention member translation path with the internal gear retention member disposed in a parallel orientation with respect to the sidewall orientation and a second position along the retention member translation path with the distal free end displaced from the inner side surface at least 0.2 inches, the internal gear retention member operably configured to be placed in rotationally retained position relative to the inner side surface with the set screw, thereby biasing the article of tactical gear within the body cavity and against the outer retainer surface and the inner side surface.

In accordance with a further feature of an alternate embodiment of the present invention, the present invention further comprises a rear sidewall defining the adjustment aperture and with an outer rear side surface and an inner rear side surface opposing the outer rear side surface, a front sidewall opposing the rear sidewall and with an outer front side surface and an inner front side surface opposing the outer front side surface, a left sidewall with an outer left side surface and an inner left side surface opposing the outer left side surface, and a right sidewall opposing the left sidewall and with an outer right side surface and an inner right side surface opposing the outer right side surface, the inner rear side surface, the inner front side surface, the inner left side surface, and the inner right side surface defining and enclosing the body cavity.

In accordance with yet another feature, the first portion is coupled to the inner rear side surface of the rear sidewall.

Although the invention is illustrated and described herein as embodied in a tactical gear holder, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time. Also, for purposes of description herein, the terms "upper", "lower", "left," "rear," "right," "front," "vertical," "horizontal," and derivatives thereof relate to the invention as oriented in the figures and is not to be construed as limiting any feature to be a particular orientation, as said orientation may be changed based on the user's perspective of the device. Furthermore, there is no intention to be bound by any expressed or implied theory presented in the preceding technical field, background, brief summary or the following detailed description.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of the holster assembly, spanning from the bottom wall to the upper edge of the sidewall of the holster.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 2:
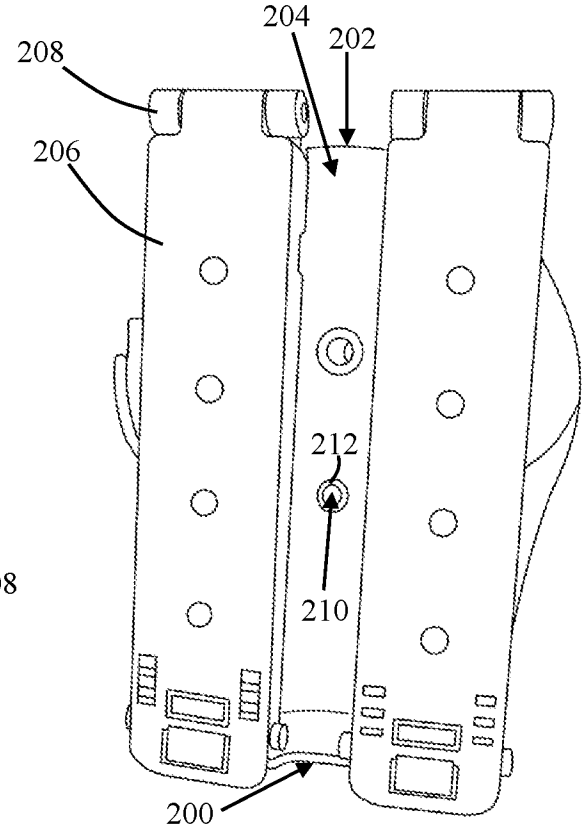
FIG. 2 is a perspective rear view of a tactical gear holder, in accordance with the present invention.
Figure 1:
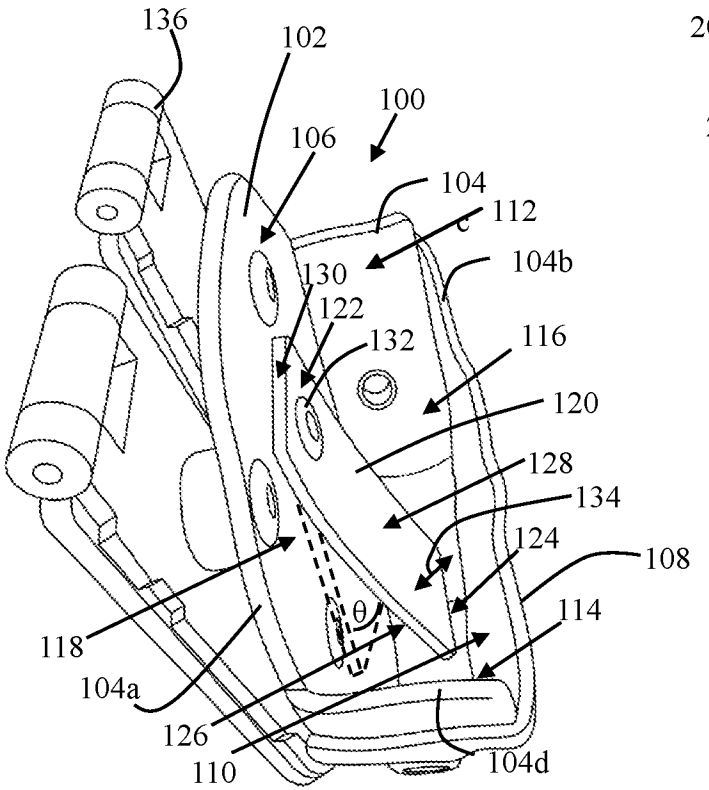
FIG. 1 is a perspective top view of a tactical gear holder, in accordance with the present invention.
Figure 4:
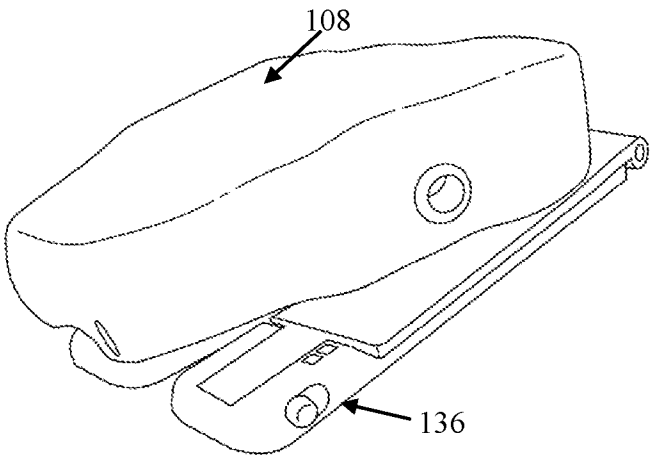
FIG. 4 is a perspective side view of a tactical gear holder, in accordance with the present invention.
Figure 3:
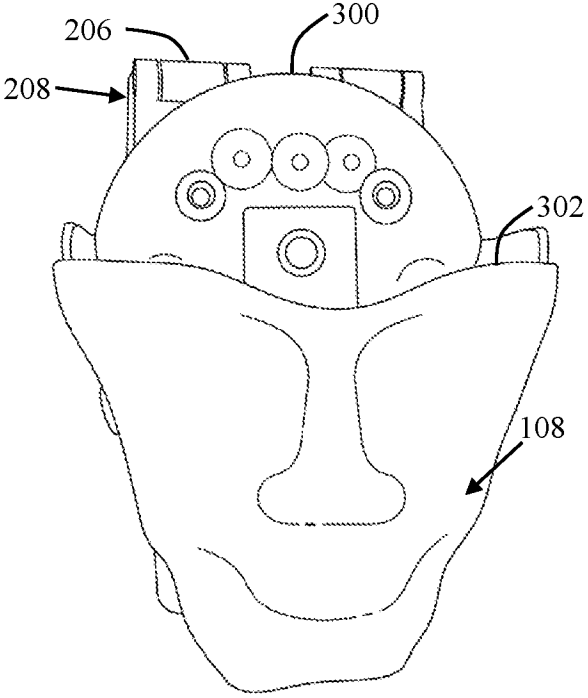
FIG. 3 is a perspective front view of a tactical gear holder, in accordance with the present invention.
Figure 6:
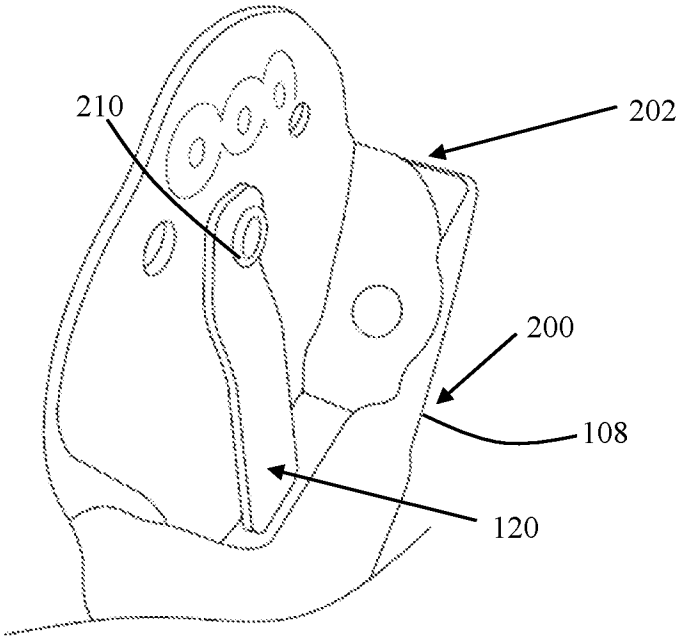
FIG. 6 is a perspective top view of a tactical gear holder, in accordance with an exemplary embodiment of the present invention.
Figure 5:
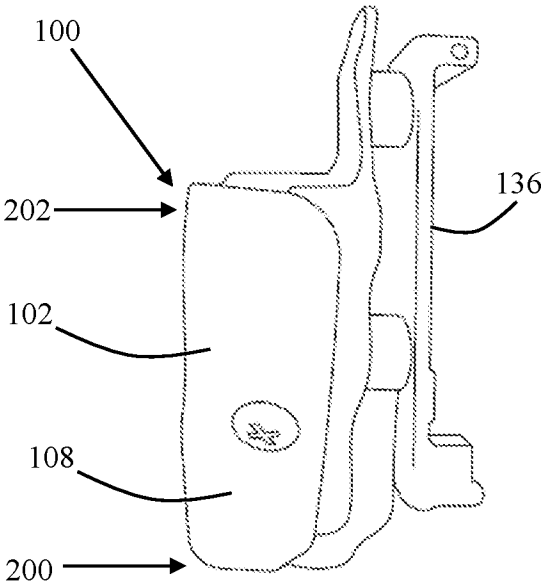
FIG. 5 is a perspective side view of an exemplary embodiment of a tactical gear holder.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

The present invention provides a novel and efficient assembly for securely retaining and storing tactical gear. Embodiments of the invention provide a compact tactical gear holder with a retention mechanism which securely holds and stores tactical gear and prevents the gear from coming loose and falling out of the tactical gear holder. In addition, embodiments of the present invention provide for a means of selectively adjusting the tactical gear holder to retain and store more than one tactical gear item.

The invention described herein provides a tactical gear holder that overcomes known disadvantages of those known devices and methods of this general type and that effectively, efficiently, and safely retain tactical gear (e.g., handcuffs, flashlights, firearm magazines, etc.). Although the invention is illustrated and described herein as embodied in a tactical gear holder, it is, nevertheless, not intended to be limited to the details shown because various modifications and structural changes may be made therein without departing from the spirit of the invention. Additionally, well-known elements of exemplary embodiments of the invention will not be described in detail or will be omitted so as not to obscure the relevant details of the invention.

Referring now to FIGS. 1-9, embodiments of the present invention and components thereon are shown. The figures show several advantageous features of the present invention, but, as will be described below, the invention can be provided in several shapes, sizes, combinations of features and components, and varying numbers and functions of the components. The first example of a tactical gear holder 100, includes a holster body 102 having a lower end 200, an upper end 202 opposing the lower end 200 and defining an upper aperture 118 sized to receive an article of tactical gear. In an exemplary embodiment, the holster body 102 is of a substantially rigid material, in that it maintains its shape upon being subjected to conventional forces ranging from 1-200 lbs. The substantially rigid nature of the holster body 102 is significant in that it prevents the cuffs or other tactical equipment from being manipulated from external forces, e.g., a body part of the user when sitting down or otherwise in movement. In one embodiment, the holster body 102 may be casted from a single material, e.g., PVC plastic or stainless steel. In other embodiments, the holster body 102 may be assembled from one or more pieces, e.g., a front and rear shell, using fasteners or welding. In a preferred embodiment, the holster body 102 is handheld and portable, wherein "handheld" and "portable" refers to having the ability to be held by a user with a single hand and carried around without external equipment or forces other than that which is provided by the user. In a preferred embodiment, the holster body 102 is made by coupling two u-shaped shells together with fasteners (as shown best in FIG. 1 and FIG. 4) or through another substantially similar means.

The holster body 102 further comprises a rear sidewall 104*a* defining an adjustment aperture 212 and has an outer rear side surface 204 and an inner rear side surface 106 opposing the outer rear side surface 204, a front sidewall 104*b* opposing the rear sidewall 104*a* and with an outer front side surface 108 (as best exemplified in FIGS. 3-7) and an inner front side surface 110 opposing the outer front side surface 108, a left sidewall 104*c* with an outer left side surface and an inner left side surface 112 opposing the outer left side surface, and a right sidewall 104*d* opposing the left sidewall 104*c* and with an outer right side surface and an inner right side surface 114 opposing the outer right side surface. The inner rear side surface 106, the inner front side surface 110, the inner left side surface 112, and the inner right side surface 114 may define and enclose a body cavity 116 (as exemplified best in the perspective top view depicted in FIG. 9) sized to receive the article of tactical gear.

In one embodiment, the upper aperture 118 may be enclosed and may be approximately 1-2 inches in width (i.e., from side-to-side) and approximately 3-4 inches in length (i.e., from end-to-end). The upper aperture 118 may spatially connect with the body cavity 116 to permit one or more entry and removal of one or more tactical items. The tactical item may preferably be a pair of handcuffs. The body cavity 116 may be rectangular in one embodiment and/or another shape and size to receive one or more tactical items.

In a preferred embodiment, the holster body 102 further comprises an internal gear retention member 120 with an inner retainer surface 126, an outer retainer surface 128 opposing the inner retainer surface 126, a first portion 122 coupled to the inner rear side surface 106 of the rear sidewall 104*a*, and a distal free end 124 operably configured to selectively translate, independent of the first portion 112 of the internal gear retention member 120, within the body cavity 116 through rotation of a set screw 210 disposed within the adjustment aperture 212. As such, rotation of set screw 210 biases the article of tactical gear within the body cavity 116 and against the outer retainer surface 128 and the inner front side surface 110. As used herein, "distal end" is defined as operably configured to freely move back and forth (based on internal clearances dictated by the gear being retained). In an exemplary embodiment, the internal gear retention member 120 is of a substantially rigid material, in that it maintains its shape upon being subjected to conventional forces ranging from 1-200 lbs. The substantially rigid nature of the internal gear retention member 120 is significant in that it prevents the cuffs or other tactical equipment from being manipulated from external forces, e.g., a body part of the user when sitting down or otherwise in movement. In one embodiment, the internal gear retention member 120 may be casted from a single material, e.g., PVC plastic or stainless steel.

Figure 9:
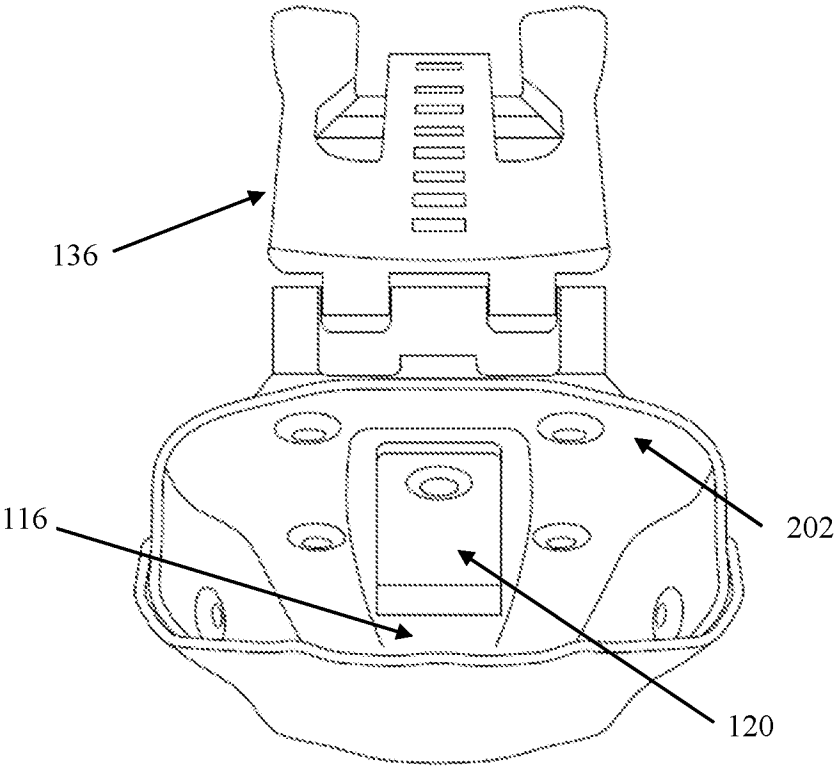
FIG. 9 is a perspective top view of an exemplary tactical gear holder.
Figure 10:
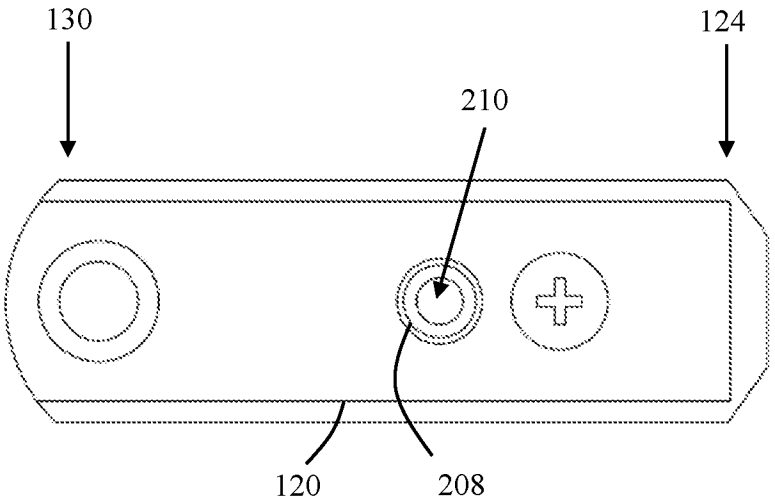
FIG. 10 is an elevational front view of an internal gear retention member, in accordance with an exemplary embodiment of the present invention.
Figure 11:
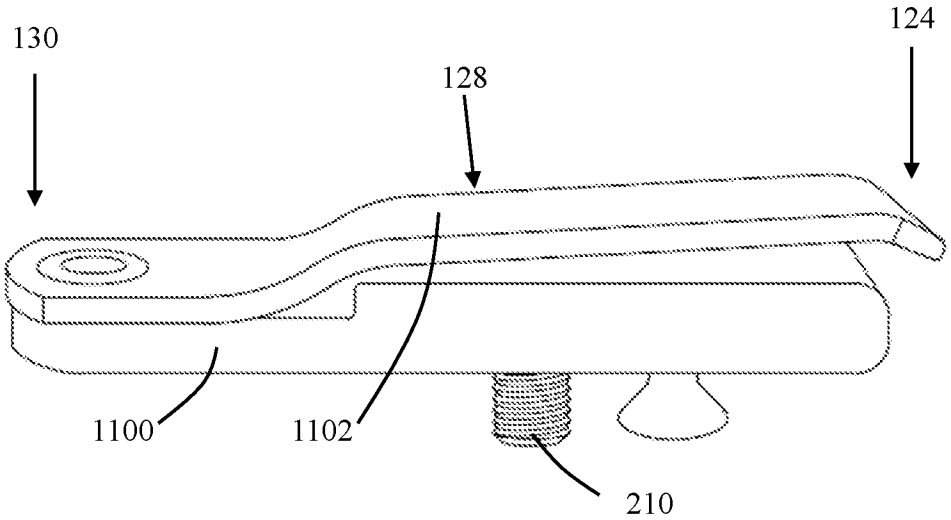
FIG. 11 is a perspective side view of an internal gear retention member, in accordance with an exemplary embodiment of the present invention.

In a preferred embodiment, the internal gear retention member 120 is beneficially coupled to the holster body 102 and is operably configured to selectively extend in and retract from the holster body 102 and bias the article of tactical gear within the body cavity 116 and against the outer retainer surface 128 and the inner front side surface 110. In another embodiment, as depicted in FIGS. 9-11, the internal gear retention member 120 is also selectively removable from the body 102 using one or more fasteners and is comprised of two components, i.e., a retainer body component 1100 and a spring member component 1102. As seen in the other figures, the spring or flexing member component 1102 is the sole component making up the internal gear retention member.

In one embodiment, the internal gear retention member 120 forms a portion of the inner sidewall surface and may be of a substantially rigid material, e.g., a polymer plastic known as "kydex." The internal gear retention member 120 may also be located on a bottom wall formed on the holster body 102 and may have dimensions of approximately 0.25×0.63×2.25 inches. The holster body 102 may have dimensions of approximately 0.08×0.75×2.50 inches. The internal gear retention member 120 may be mounted on the holster body 102 with a single point of contact, e.g., through a rivet. This rivet may also be one of two connection points for the internal gear retention member 120.

In accordance with a further feature of the present invention, the tactical gear holder 100 may further comprise at least one fastening member 136 coupled to the outer rear side surface 204 of the rear sidewall 104*a* and operably configured to securely fasten the holster body 102 to an article of clothing. The fastening member 136 may be coupled to the holster body 102 using a rivet, a bolt, screw, or other comparable fastener. Although FIGS. 1-4 depict the tactical gear holder 100 with two fastening members 136, the tactical gear holder 100 may comprise only one fastening member 136 in alternate embodiments. FIG. 9 depicts an exemplary tactical gear holder 100 comprising a single fastening member 136. The fastening member 136 may be a U-clip, a tongue-and-groove fastening configuration, a pin/clasp configuration, or another type of fastening member.

As best seen in FIGS. 1-4, the at least one fastening member 136 may include two clasp members 206, 208 with one of the two clasp members 206, 208 operably configured to rotate and mechanically couple to another of the two clasp members 206, 208 to securely fasten the holster body 102 to the article of clothing, to a belt clip, or to another surface (preferably worn by the user).

In an exemplary embodiment, the rear sidewall 104*a* includes an upper rear edge 300 defining the upper end 202 of the holster body 102 and defines a rear sidewall length separating the upper rear edge 300 of the rear sidewall 104*a* and the lower end 200 of the holster body 102 and wherein the front sidewall 104*b* includes an upper front edge 302 defining the upper end 202 of the holster body 102 and defining a front sidewall length separating the upper front edge 302 of the front sidewall 104*b* and the lower end 200 of the holster body 102. The rear sidewall length is may be greater than the front sidewall length by at least 10% of the front sidewall length. With the rear sidewall being greater in length than the front sidewall, users (particularly military and law enforcement personnel) can quickly, easily, and beneficially access the handcuffs or other tactical gear or equipment being retained within the tactical gear holder 100. To further facilitate ease of access, the upper rear edge 300 is convex so as to reduce pressure on the user and the upper front edge 302 is concave, preferably at the center axis of the body 102, to allow the user to effectively access the handcuffs or other tactical gear retained therein.

The internal gear retention member 120 may further comprise a proximal end 130 opposite the distal free end 124, wherein the first portion 122 includes the proximal end 130 of the internal gear retention member 120 and with the inner retainer surface 126 flush against the inner rear side surface 106 of the rear sidewall 104*a* at the first portion 122 and retained thereto with a fastener 132.

Figure 8:
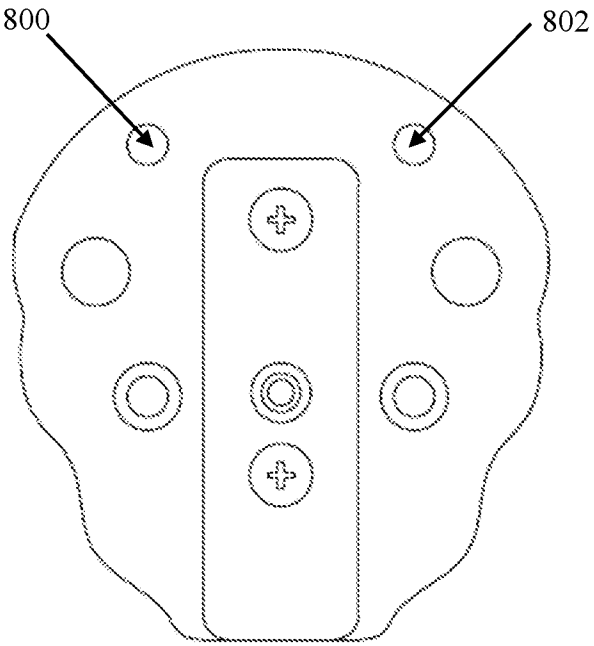
FIG. 8 is a perspective rear view of a tactical gear holder, in accordance with an exemplary embodiment of the present invention.
Figure 7:
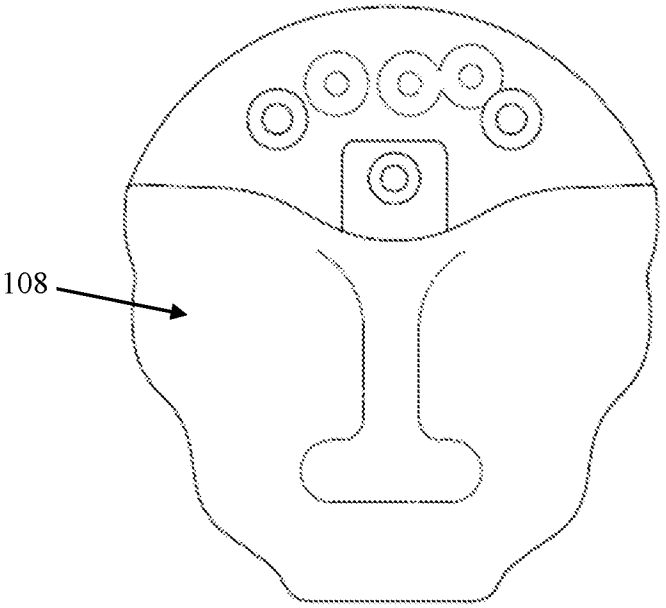
FIG. 7 is a perspective front view of a tactical gear holder, in accordance with an exemplary embodiment of the present invention.

In one embodiment, rotation of the set screw 210 is operably configured to generate an acute angle, θ, with respect to the distal free end 124 and the inner rear side surface 106 of the rear sidewall 104*a*. In another embodiment, the rotation of the set screw 210 may be operably configured to place the distal free end 124 in a rotationally retained position relative to the inner rear side surface 106 of the rear sidewall 104*a*. Said another way, an end of the screw 210 prevents the distal free end 124 from moving back toward the inner rear side surface 106. The internal gear retention member 120 is selectively adjustable (i.e., extended or retracted) utilizing the set screw 210 that, in an exemplary embodiment, is approximately ¼ inches in diameter. As best seen in FIG. 8, the inner rear side surface 106 may further comprise at least one mounting aperture 800, 802 for the internal gear retention member 120 which preferably uses an #8-32 machine truss head screw. The set screw 210 is spatially situated between the mounting apertures 800, 802 and allows for adjustment of the internal gear retention member 120 via a ⅛-inch Allan wrench. Said another way, the rear face of the sidewall may include an aperture providing access to the user to insert an Allan wrench or other tool to selectively adjust the internal gear retention member 120. In other embodiments, the internal retention member may be biased inwardly toward the body cavity 116 using a spring member, e.g., using a separate spring or the material of the internal gear retention member 120 as a spring. As such, tactical articles are beneficially retained by the internal gear retention member 120 and the sidewall (or other structure), thereby preventing inadvertent removal. Said another way, the user is required to exert a pulling force onto the tactical article in order to the remove it from within the body cavity 116, e.g., approximately 2-5 lbs.

In one embodiment, the internal gear retention member 120 is statically disposed at an acute angle with respect to the inner rear side surface 106, whereby the distal end 124 of the internal gear retention member 120 is spaced farther from the inner rear side surface 106 and in the body cavity 116 than the proximal end 130. In one embodiment, the outer retainer surface 128 of the internal gear retention member 120 does not flex when the tactical article is inserted into the body. In other embodiments, the outer retainer surface 128 of the internal gear retention member 120 does flex when the tactical article is inserted into the body, but either way compresses (with the sidewall) the tactical article.

As seen in FIGS. 1-12, the outer retainer surface 128 may be substantially planar in one embodiment and forms a curvilinear shape spanning from a proximal end 130 of the internal gear retention member 120 opposite the distal free end 124. The outer retainer surface 128 is shaped such that the user can access tactical article either from the side or the top of the body 102. As depicted best in FIGS. 8-9, the body 102 may also include one or more attachment housings operably configured to retain (using one or more fasteners)

additional tactical articles, e.g., firearm magazines, thereto. Beneficially, the body 102 may be operably configured to rotate 360° with respect to an attachment point defined by a fastener coupling the at least one fastening member 136 to the holster body 102 and may rotate (and lock) in at 45° increments. The assembly is also configured to change mounting systems as needed between molded clips, Molleloks, Tek-Loks, Malace clips, Paddles, etc. Additionally, chain cuffs are almost all able to fit one case Smith and Wesson Thompson, viper peerless chain cuffs all fit this one single body 102. The holster body 102 is beneficially designated by the similar styles of the cuff and is configured to retain at least 15 different cuffs, different magazine cases, spray cases, flashlight cases, baton cases, radio cases, and cameras, among others.

In accordance with one embodiment of the present invention, the holster body has the lower end 200, the upper end 202 opposing the lower end 200 and defining the upper aperture 118 sized to receive an article of tactical gear and the sidewall 104 with the inner side surface enclosing and defining the body cavity 116 sized to receive the article of tactical gear. The sidewall 104 defines the adjustment aperture 212. The holster body 104 further comprises the internal gear retention member 120 with the inner retainer surface 126, the outer retainer surface 128 opposing the inner retainer surface 126, the first portion 122 coupled to the inner side surface with the fastener 132, and the distal free end 124 operably configured to selectively translate, independent of the first portion 112 of the internal gear retention member 120, within the body cavity 116 through rotation of the set screw 210 disposed within the adjustment aperture 212. The internal gear retention member 120 may have a first position along a retention member translation path 134 with the internal gear retention member 120 disposed in a parallel orientation with respect to the sidewall orientation 104, wherein "parallel orientation" is defined as substantially parallel, i.e., +/−5° of 0° (the substantially parallel orientation as shown with dashed lines in FIG. 1) and a second position along the retention member translation path 134 with the distal free end 124 displaced from the inner side surface at least 0.2 inches. The internal gear retention member 120 is operably configured to be placed in rotationally retained position relative to the inner side surface 106 with the set screw, thereby biasing the article of tactical gear within the body cavity 116 and against the outer retainer surface 128 and the inner side surface.

In accordance with a further feature of this alternate embodiment, the holster body 102 further comprises the rear sidewall 104*a* defining the adjustment aperture 212 and with the outer rear side surface 204 and the inner rear side surface 106 opposing the outer rear side surface 204, the front sidewall 104*b* opposing the rear sidewall 104*a* and with the outer front side surface 108 and the inner front side surface 110 opposing the outer front side surface 108, the left sidewall 104*c* with the outer left side surface and the inner left side surface 112 opposing the outer left side surface, and the right sidewall 104*d* opposing the left sidewall 104*c* and with the outer right side surface and the inner right side surface 114 opposing the outer right side surface. Again, the inner rear side surface 106, the inner front side surface 110, the inner left side surface 112, and the inner right side surface 114 may define and enclose the body cavity 116.

The first portion 122 may be beneficially coupled to the inner rear side surface 106 of the rear sidewall 104*a* to securely anchor the internal gear retention member 120 to the holster body 102 and provide a sufficient degree of compression to retain and store tactical gear, equipment, or other comparable items within the body cavity 116. The first portion 122 may be located at the terminal end or proximal (within 10% of the overall length) of the internal gear retention member 120.

Figure 12:
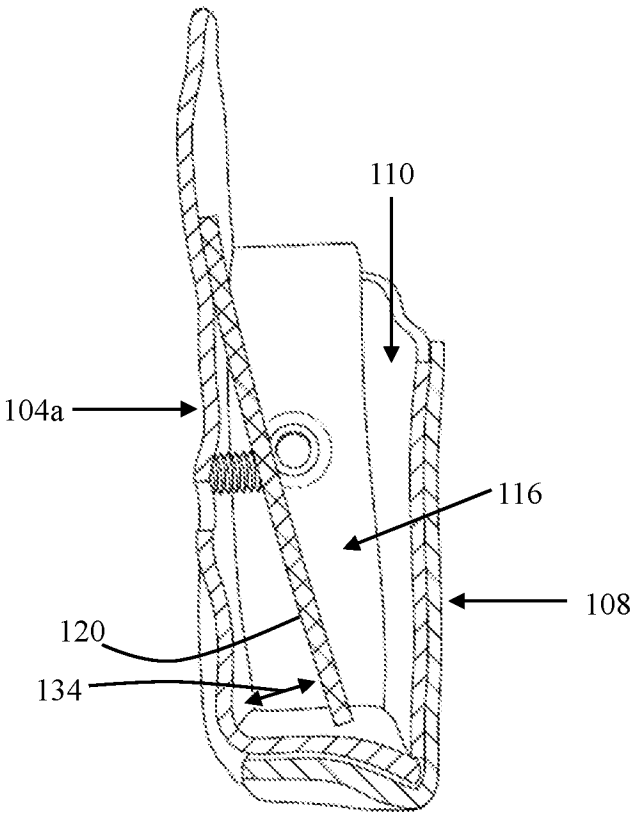
FIG. 12 is a cross-sectional side view of a tactical gear holder, in accordance with an exemplary embodiment of the present invention.

FIG. 12 depicts a cross-sectional side view of an exemplary tactical gear holder, featuring the rear sidewall 104*a* of the holster body 102, the inner front side surface 110 of the holster body 102, the outer front side surface 108 of the holster body 102, and the internal gear retention member 120. As seen in FIG. 12, the internal gear retention member 120 is designed to selectively compress along a retention member translation path 134 when an article of tactical gear is placed within the body cavity 116 by a user applying pressure, i.e., a pushing force downward on the article of tactical gear, onto the article of tactical gear. To remove the article of tactical gear from within the body cavity 116, the user is required to exert a pulling force onto the tactical article, e.g., approximately 2-5 lbs, which in turn decompresses the internal gear retention member 120 and releases the article of tactical gear from within the body cavity 116.

What is claimed is:

1. A tactical gear holder comprising:

a holster body having:

a lower end, an upper end opposing the lower end and defining an upper aperture sized to receive an article of tactical gear; and a rear sidewall defining an aperture for a fastener and an adjustment aperture and with an outer rear side surface and an inner rear side surface opposing the outer rear side surface, a front sidewall opposing the rear sidewall and with an outer front side surface and an inner front side surface opposing the outer front side surface, a left sidewall with an outer left side surface and an inner left side surface opposing the outer left side surface, and a right sidewall opposing the left sidewall and with an outer right side surface and an inner right side surface opposing the outer right side surface, the inner rear side surface, the inner front side surface, the inner left side surface, and the inner right side surface defining and enclosing a body cavity sized to receive the article of tactical gear;

an internal gear retention member with an inner retainer surface, an outer retainer surface opposing the inner retainer surface, a first portion, including a proximal end of the internal gear retention member, coupled to the inner rear side surface of the rear sidewall with a fastener spanning through the aperture for the fastener defined on the rear sidewall and with the inner retainer surface flush against the inner rear side surface of the rear sidewall, and a distal free end, opposing the proximal end of the internal gear retention member, operably configured to selectively translate, independent of the first portion of the internal gear retention member, within the body cavity through rotation of a set screw disposed and selectively adjustable within the adjustment aperture, thereby biasing the article of tactical gear within the body cavity and against the outer retainer surface and the inner front side surface; and at least one fastening member coupled to the outer rear side surface of the rear sidewall, operably configured to securely fasten the holster body to an article of clothing, and defining an opening substantially perpendicular to the outer rear surface of the rear sidewall configured thereon for accessing the adjustment aperture defined by the rear sidewall.

2. The tactical gear holder according to claim 1, wherein: the holster body and the internal gear retention member are of a rigid material.

3. The tactical gear holder according to claim 1, wherein: the at least one fastening member includes two clasp members with one of the two clasp members operably configured to rotate and mechanically couple to another of the two clasp members to securely fasten the holster body to the article of clothing.

4. The tactical gear holder according to claim 1, wherein: the body is operably configured to rotate 360° with respect to an attachment point defined by a fastener coupling the at least one fastening member to the body.

5. The tactical gear holder according to claim 1, wherein: the rear sidewall includes an upper rear edge defining the upper end of the holster body and defines a rear sidewall length separating the upper rear edge of the rear sidewall and the lower end of the holster body and wherein the front sidewall includes an upper front edge defining the upper end of the holster body and defining a front sidewall length separating the upper front edge of the front sidewall and the lower end of the holster body, the rear sidewall length greater than the front sidewall length by at least 10% of the front sidewall length.

6. The tactical gear holder according to claim 1, wherein: rotation of the set screw is operably configured to generate an acute angle with respect to the distal free end and the inner rear side surface of the rear sidewall.

7. The tactical gear holder according to claim 1, wherein: the outer retainer surface is planar and forms a curvilinear shape spanning from a proximal end of the internal gear retention member opposite the distal free end.

8. The tactical gear holder according to claim 1, wherein: rotation of the set screw is operably configured to place the distal free end in a rotationally retained position relative to the inner rear side surface of the rear sidewall.

9. A tactical gear holder comprising:

a holster body having a lower end, an upper end opposing the lower end and defining an upper aperture sized to receive an article of tactical gear and a sidewall with an inner side surface enclosing and defining a body cavity sized to receive the article of tactical gear, the sidewall with a rear sidewall defining an adjustment aperture and an aperture for a fastener;

an internal gear retention member with an inner retainer surface, an outer retainer surface opposing the inner retainer surface, a first portion, including a proximal end of the internal gear retention member, coupled to the inner side surface with a fastener spanning through the aperture for the fastener defined on the rear sidewall and with the inner retainer surface flush against the inner side surface of the rear sidewall, and a distal free end, opposing the proximal end of the internal gear retention member, operably configured to selectively translate, independent of the first portion of the internal gear retention member, within the body cavity through rotation of a set screw disposed and selectively adjustable within the adjustment aperture, the internal gear retention member having a first position along a retention member translation path with the internal gear retention member disposed in a parallel orientation with respect to the sidewall orientation and a second position along the retention member translation path with the distal free end displaced from the inner side surface at least 0.2 inches, the internal gear retention member operably configured to be placed in rotationally retained position relative to the inner side surface with the set screw, thereby biasing the article of tactical gear within the body cavity and against the outer retainer surface and the inner side surface; and at least one fastening member coupled to an outer rear side surface of the rear sidewall, opposing the inner rear side surface of the rear sidewall, operably configured to securely fasten the holster body to an article of clothing, and defining an opening substantially perpendicular to the outer rear surface of the rear sidewall configured thereon for accessing the adjustment aperture defined by the rear sidewall.

10. The tactical gear holder according to claim 9, wherein the sidewall further comprises:

a front sidewall opposing the rear sidewall and with an outer front side surface and an inner front side surface opposing the outer front side surface, a left sidewall with an outer left side surface and an inner left side surface opposing the outer left side surface, and a right sidewall opposing the left sidewall and with an outer right side surface and an inner right side surface opposing the outer right side surface, the inner rear side surface, the inner front side surface, the inner left side surface, and the inner right side surface defining and enclosing the body cavity.

11. The tactical gear holder according to claim 9, wherein: the holster body and the internal gear retention member are of a rigid material.

12. The tactical gear holder according to claim 9, wherein: the at least one fastening member includes two clasp members with one of the two clasp members operably configured to rotate and mechanically couple to another of the two clasp members to securely fasten the holster body to the article of clothing.

13. The tactical gear holder according to claim 9, wherein: the body is operably configured to rotate 360° with respect to an attachment point defined by a fastener coupling the at least one fastening member to the body.

14. The tactical gear holder according to claim 10, wherein:

the rear sidewall includes an upper rear edge defining the upper end of the holster body and defines a rear sidewall length separating the upper rear edge of the rear sidewall and the lower end of the holster body and wherein the front sidewall includes an upper front edge defining the upper end of the holster body and defining a front sidewall length separating the upper front edge of the front sidewall and the lower end of the holster body, the rear sidewall length greater than the front sidewall length by at least 10% of the front sidewall length.

15. The tactical gear holder according to claim 9, wherein: rotation of the set screw is operably configured to generate an acute angle with respect to the distal free end and the inner rear side surface of the rear sidewall.

* * * * *